US009045916B2

(12) United States Patent
Zuraski et al.

(10) Patent No.: US 9,045,916 B2
(45) **Date of Patent: *Jun. 2, 2015**

(54) DISC ALIGNMENT MECHANISM

(71) Applicant: Schlage Lock Company LLC, Indianapolis, IN (US)

(72) Inventors: Robert David Zuraski, Taunton, MA (US); Mary Teresa Sarich, Boston, MA (US); Daniel Hugh Kindstrand, Plainville, MA (US); David Bruce Miller, Braintree, MA (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/963,897

(22) Filed: Aug. 9, 2013

(65) Prior Publication Data

US 2014/0041428 A1 Feb. 13, 2014

Related U.S. Application Data

(60) Provisional application No. 61/681,546, filed on Aug. 9, 2012.

(51) Int. Cl.
*E05B 29/04* (2006.01)
*E05B 21/06* (2006.01)

(52) U.S. Cl.
CPC ..... *E05B 21/066* (2013.01); *E05B 21/06* (2013.01)

(58) Field of Classification Search
CPC ..... E05B 21/006; E05B 29/0013; E05B 29/0033; E05B 29/00; E05B 21/066
USPC ..... 70/303 R, 303 A, 419, 365, 366, 492, 70/495, 321, 322
See application file for complete search history.

(56) References Cited

U.S. PATENT DOCUMENTS 293,885 A 2/1884 Jackson
1,226,257 A 5/1917 Ritzert
(Continued)

FOREIGN PATENT DOCUMENTS

CN 2138172 Y 7/1993
EP 0212468 8/1986
(Continued)

OTHER PUBLICATIONS

International Search Report and Written Opinion corresponding to PCT application (i.e., PCT/US2013/054412), mailed Jan. 29, 2014 (9 pages).
(Continued)

*Primary Examiner* — Lloyd Gall
(74) *Attorney, Agent, or Firm* — Krieg DeVault LLP

(57) ABSTRACT

A lock apparatus including a plurality of locking discs rotatable about a rotational axis between locked and unlocked states and each having a locking engagement surface, at least one driver disc rotatable about the rotational axis and having a driving engagement surface, a movable catch having a catch surface that abuts the locking engagement surface of the locking discs when the movable catch is in a locked position such that rotation of the locking discs is inhibited. The catch surface does not abut the locking engagement surface of the locking discs when the movable catch is in an unlocked position such that rotation of the locking discs is enabled. The driving engagement surface of the driver disc engages a portion of the movable catch upon rotation of the driver disc to thereby displace the movable catch from the locked position to the unlocked position.

25 Claims, 2 Drawing Sheets

(56) References Cited

U.S. PATENT DOCUMENTS

| | | | | | |
|---|---|---|---|---|---|
| 1,376,256 | A | | 4/1921 | Conte | |
| 2,139,842 | A | * | 12/1938 | Miller | 70/495 |
| 2,219,866 | A | * | 10/1940 | Futran | 70/383 |
| 2,524,339 | A | | 10/1950 | Young et al. | |
| 2,578,211 | A | | 12/1951 | Spain | |
| 2,648,973 | A | * | 8/1953 | Spain | 70/366 |
| 2,696,727 | A | * | 12/1954 | Schlabach | 70/421 |
| 2,729,091 | A | | 1/1956 | Taylor | |
| 2,782,624 | A | * | 2/1957 | Pelle | 70/419 |
| 3,172,968 | A | * | 3/1965 | Arendt | 200/43.03 |
| 3,548,620 | A | | 12/1970 | Genakis | |
| 3,738,135 | A | * | 6/1973 | Seidewand | 70/490 |
| 3,928,992 | A | | 12/1975 | Talbot | |
| 4,267,717 | A | | 5/1981 | Martikainen | |
| 4,351,172 | A | | 9/1982 | Martikainen | |
| 4,370,875 | A | | 2/1983 | Piiroinen | |
| 4,407,147 | A | | 10/1983 | Larson | |
| 5,086,631 | A | * | 2/1992 | Agbay | 70/366 |
| 5,279,138 | A | | 1/1994 | Gallagher | |
| 5,488,847 | A | * | 2/1996 | Lai et al. | 70/419 |
| 5,490,405 | A | | 2/1996 | Ramo et al. | |
| 6,591,645 | B1 | | 7/2003 | Wittwer | |
| 6,725,696 | B1 | | 4/2004 | Blight et al. | |
| 6,799,447 | B2 | | 10/2004 | Mielonen et al. | |
| 6,854,305 | B2 | | 2/2005 | Hurskainen et al. | |
| 6,880,376 | B1 | | 4/2005 | Ko | |
| 7,225,651 | B2 | * | 6/2007 | Edwards et al. | 70/369 |
| 7,665,333 | B2 | | 2/2010 | Shabtay et al. | |
| 7,703,311 | B2 | | 4/2010 | Agbay | |
| 8,074,480 | B2 | | 12/2011 | Huang | |
| 8,091,393 | B2 | | 1/2012 | Damikolas et al. | |
| 8,117,876 | B2 | | 2/2012 | Mathachan | |
| 8,347,678 | B2 | | 1/2013 | Chong | |
| 8,424,349 | B2 | | 4/2013 | Marcelle et al. | |
| 2006/0016230 | A1 | | 1/2006 | Loughlin et al. | |
| 2006/0048554 | A1 | | 3/2006 | Keller | |
| 2008/0022734 | A1 | | 1/2008 | McDaid et al. | |
| 2011/0265526 | A1 | | 11/2011 | Zuraski | |
| 2013/0067972 | A1 | | 3/2013 | Buhl | |

FOREIGN PATENT DOCUMENTS

| | | |
|---|---|---|
| EP | 2085542 | 1/2009 |
| EP | 2360333 | 2/2011 |

OTHER PUBLICATIONS

Machine translation for CN2138172Y.

* cited by examiner

DISC ALIGNMENT MECHANISM

CROSS REFERENCE TO RELATED APPLICATIONS

The present application claims the benefit of U.S. Provisional Patent Application 61/681,546 filed Aug. 9, 2012, the contents of which are incorporated herein by reference in their entirety.

TECHNICAL FIELD

The present invention relates generally to locks, and more particularly, but not exclusively, relates to disc tumbler locks.

BACKGROUND

Conventional disc-style cylinders suffer from a variety of disadvantages and problems including misalignment of the lock discs and susceptibility to lock-picking. For example, the discs can easily become misaligned, in which case the user must rotate the key back and forth to re-align the discs. Furthermore, there is no indication to the user that the key is fully inserted, and the key and contacted discs will turn through the first portion of their travel (usually 90 degrees) even when the key is only partially inserted. Because the key turns, the user might incorrectly assume that that key has been inserted correctly, but the lock will not open due to the partial insertion of the key. This can lead to user frustration and confusion, and often results in the user applying too much force which may cause the key to break. Additionally, in conventional disc-style cylinders, it is possible for a skilled lock-picker to feel the change in tension as one or more discs rotate. A release of tension typically indicates the correct position for a disc, thereby increasing susceptibility of the lock to be picked.

There is therefore a need for unique and inventive apparatuses, systems and methods to address various disadvantages and problems associated with conventional disc-style cylinders.

SUMMARY

Unique locking cylinders are disclosed. In an exemplary embodiment, a locking cylinder includes a locking disc, a driver disc and a catch. The catch selectively prevents rotation of the locking disc. The driver disc is operable to move the catch between a first position in which the catch prevents rotation of the locking disc, and a second position in which the catch does not prevent rotation of the locking disc. In the second position, the catch may apply pressure to the locking disc.

DETAILED DESCRIPTION

Figure 1:
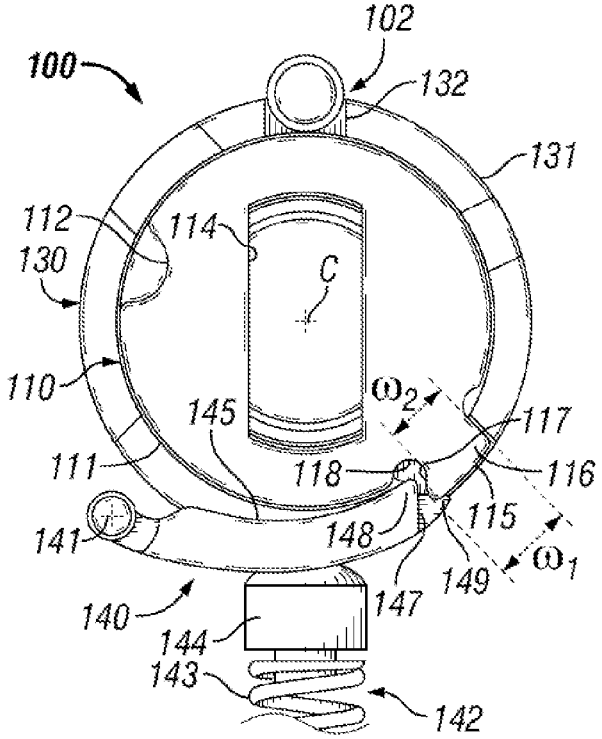
FIG. 1 is an elevational illustration of a lock assembly according to an embodiment of the present invention in a first state or operational configuration.

For the purposes of promoting an understanding of the principles of the invention, reference will now be made to the embodiments illustrated in the drawings and specific language will be used to describe the same. It will nevertheless be understood that no limitation of the scope of the invention is hereby intended. Any alterations and further modifications in the described embodiments, and any further applications of the principles of the invention as described herein are contemplated as would normally occur to one skilled in the art to which the invention relates.

Figure 2:
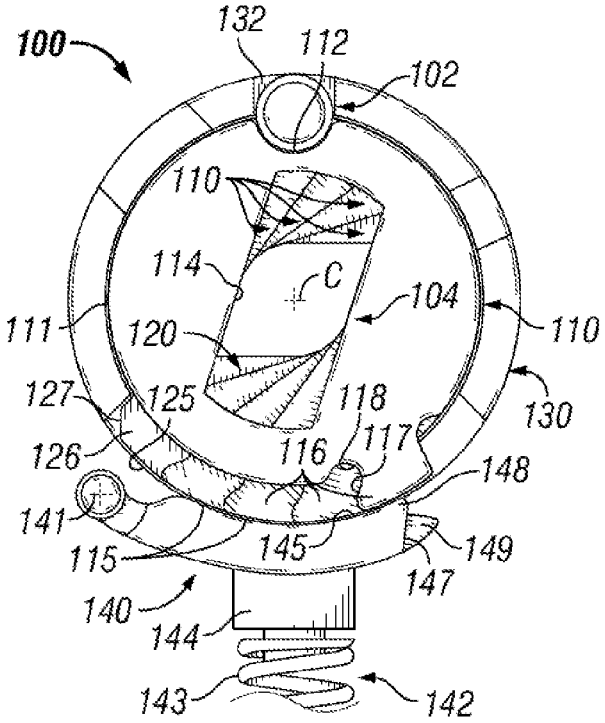
FIG. 2 is an elevational illustration of the lock assembly of FIG. 1 in a second state or operational configuration.
Figure 3:
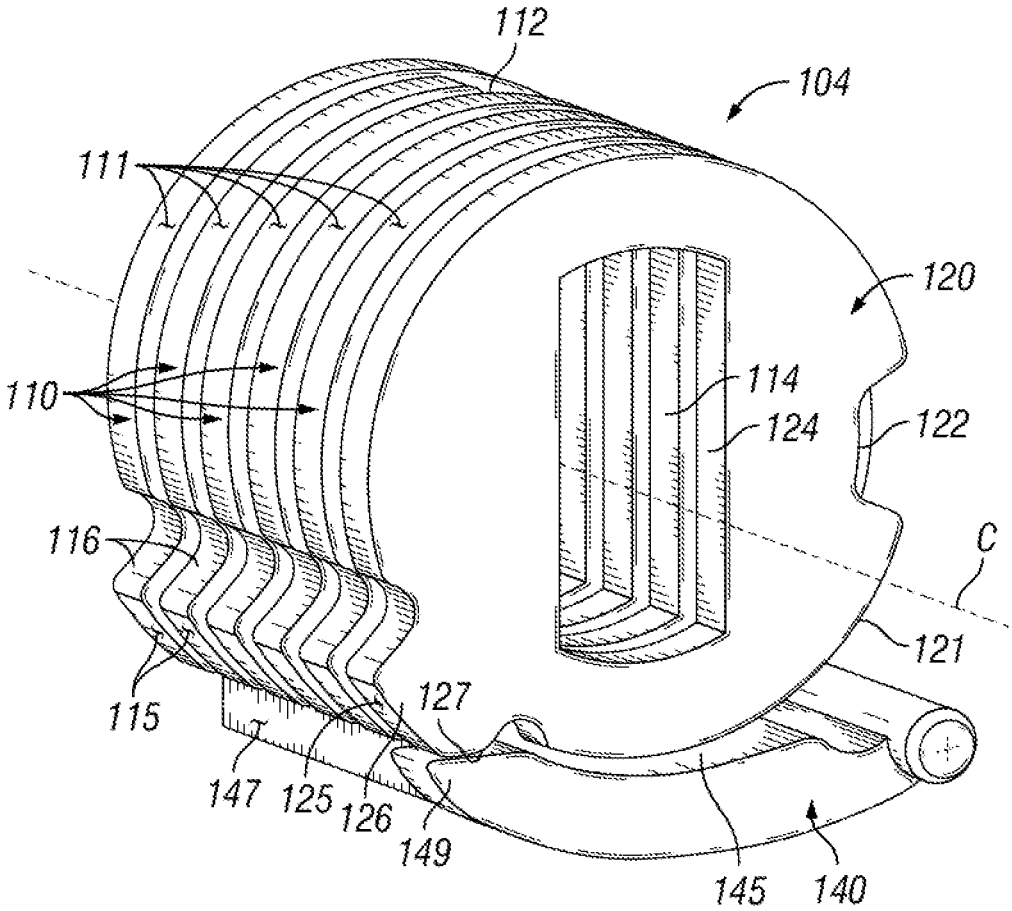
FIG. 3 is a perspective illustration of a subassembly of the lock assembly of FIG. 1.

With reference to FIGS. 1-3, an illustrative locking system 100 according to one form of the invention generally includes a tumbler system having a locking bar 102 that interacts with disc stack 104 including a plurality of locking discs 110 and at least one driving disc 120, a plug housing 130 at least partially surrounding the disc stack 104, a movable catch 140, and a biasing mechanism 142 that exerts a biasing force against the movable catch 140 to engage the movable catch 140 against the disc stack 104. Although a particular type of a tumbler system is illustrate in FIGS. 1-3, it should be understood that other types and configurations of tumbler systems are also contemplated for use in association with the locking system 100 including, for example, a pin tumbler system. Furthermore, while the movable catch 140 is illustrated as a pivoting member that is pivotally movable between one or more operational positions, it should be understood that the movable catch 140 may be movable in additional or alternative directions.

In the illustrated embodiment, the locking discs 110 and the driving disc 120 are coaxially aligned along an axial centerline or axis C, and together form at least a portion of the disc stack 104. While five locking discs 110 are shown in the illustrated embodiment, it should be appreciated that the disc stack 104 may include more or fewer locking discs 110. Each locking disc 110 is generally cylindrical in shape, and may include a circumferential outer surface 111, a groove or indentation 112 formed in the circumferential outer surface 111, a keyway 114 positioned generally along the axial centerline C, a radial protrusion 116 projecting radially beyond the circumferential outer surface 111, and a hooked-shaped recess 118 extending between the circumferential outer surface 111 and the radial protrusion 116. In the illustrated embodiment, the radial protrusion 116 has a first width $w_1$ at its radially distal extent (i.e., farthest from the axial centerline C) and a smaller second width $w_2$ at its radially proximal extent (i.e., closest to the axial centerline C). As should be appreciated, the hooked-shaped recess 118 provides the radial protrusion 116 with an undercut region.

The groove/indentation 112 is sized and configured to receive the locking bar 102 (FIG. 2), and the keyway 114 is sized and configured to receive a corresponding mechanical key (not shown). In an aligned operational configuration/position of the locking discs 110, the grooves/indentations 112 are axially aligned with one another and/or are axially aligned with the axial channel 132 in the plug housing 130. In a misaligned operational configuration/position of the locking discs 110, the grooves/indentations 112 are not aligned with one another and/or are not aligned with the axial channel 132 in the plug housing 130. In the illustrated embodiment, the radial protrusion 116 generally includes an arcuate outer surface 115 extending generally in a circumferential direction, and an interference surface 117 extending inwardly from the arcuate outer surface toward the circumferential outer surface 111.

In the illustrated embodiment, the driving disc 120 is configured substantially similar to the locking discs 110, having a generally cylindrical shape and including a circumferential outer surface 121, a groove or indentation 122 formed in the circumferential outer surface 121 and sized and configured to receive the locking bar 102, and a keyway 124 positioned generally along the axial centerline C and configured to receive the corresponding mechanical key (not shown). In an aligned operational configuration/position of the driving disc 120, the groove/indentation 122 is axially aligned with the axial channel 132 in the plug housing 130. In a misaligned operational configuration/position of the driving disc 120, the groove/indentation 122 is not axially aligned with the axial channel 132 in the plug housing 130. The driving disc 120 also includes a radial protrusion 126 projecting radially beyond the circumferential outer surface 121. The radial protrusion 126 generally includes an arcuate outer surface 125 extending generally in a circumferential direction, and a contact or bearing surface 127 extending inwardly from the arcuate outer surface 125 toward the circumferential outer surface 121.

In the illustrated embodiment, each radial protrusion 116 of the locking discs 110 and the radial protrusion 126 of the driving disc 120 defines a generally uniform outer radius. In other words, the distance between the axial centerline C of disc stack 104 and the outermost portion of each radial protrusion 116, 126 is substantially equal. However, it is also contemplated that one or more of the radial protrusions 116, 126 may have a greater or lesser outer radius relative to one or more of the other radial protrusions. For example, the outer radius of radial protrusion 126 may be greater than the outer radius of the radial protrusions 116. Furthermore, while the arcuate outer surfaces 115, 125 of the radial protrusions 116, 126 each define a substantially uniform arc radius (corresponding to the outer radius of protrusions 116, 126), in other embodiments, the arcuate outer surfaces 115, 125 may not necessarily define of a uniform arc radius.

As described in further detail below, the radial protrusions 116 of the locking discs 110 interact with the movable catch/pivoting member 140 to prevent rotation of the locking discs 110 about the axial centerline C when the pivoting member 140 is in a closed position or operational configuration (FIG. 1), and the radial protrusion 126 of the driving disc 120 is configured to interact with the pivoting member 140 and pivot the pivoting member 140 away from and out of the closed position or operational configuration (FIGS. 2 and 3). In the illustrated embodiment, the driver disc 120 including the groove/indentation 122 provides a more compact system because the component that disengages the alignment mechanism is also one of the discs which interacts with the tumbler system, and no additional cylinder length is necessary to implement the system. However, in other embodiments, the driving disc 120 need not necessarily include the groove/indentation 122. In such embodiments, the tumbler system may be configured to engage only the locking discs 110, and not the driving disc 120.

In the disc stack 104, the drive disc 120 may be positioned behind the locking discs 110. That is to say, when a mechanical key is inserted into the keyway of the locking system 100, the shank of the key will pass through the keyway 114 of each of the locking discs 110 before entering the keyway 124 of the driving disc 120. This configuration, combined with the fact that the locking discs 110 cannot rotate unless the driving disc 120 has pivotally displaced the pivoting member 140 away from and out of the closed position, prevents the locking discs 110 from rotating in the absence of full insertion of a properly configured key into the keyway of the locking system 100. However, in other embodiments, some or all of the locking discs 110 or other locking elements may be positioned behind the driving disc 120.

In the illustrated embodiment, the plug housing 130 has a generally cylindrical configuration and is sized and shaped to retain the disc stack 104 within the interior region of the plug housing 130. Additionally, the plug housing 130 includes an outer surface 131 and an axial channel 132 configured to receive the locking bar 102. When the plug housing 130 is installed into a corresponding lock shell (not illustrated), the axial channel 132 is aligned with a channel formed in the shell, thereby forming a chamber in which the locking bar 102 is positioned. In embodiments which utilize pin tumblers, the axial channel 132 may be replaced by individual tumbler shafts.

When at least one of the grooves or indentations 112, 122 of the discs 110, 120 is not properly aligned with the axial channel 132 of the plug body 130, the locking bar 102 will contact the corresponding circumferential outer surface 111, 121 and will be blocked from radial displacement into the grooves/indentations 112, 122. This configuration defines a locked state of the locking system 100 (FIG. 1) in which the locking bar 102 is positioned partially in axial channel 132, and also protrudes beyond the circumferential outer surface 131. In the locked state, the locking bar 102 provides an interference between the plug body 130 and the lock shell, thereby preventing the plug body 130 from rotating with respect to the lock shell. Regardless of the type of tumbler system used, if any of the grooves/indentations 112, 122 are not aligned with the axial channel 132, a portion of the tumbler system will protrude radially beyond the circumferential outer surface 131, thereby maintaining the locking system 100 in the locked state.

When each of the grooves/indentations 112, 122 are aligned with the axial channel 132 of the plug body 130, the locking bar 102 is free to travel radially inward into each of the aligned grooves/indentations 112, 122. This configuration defines an unlocked state of the locking system 100 (FIG. 2) in which the locking bar 102 is positioned partially in the axial channel 132, and partially in the aligned grooves/indentations 112, 122. In the unlocked state, the locking bar 102 does not provide an interference between the plug body 130 and the lock shell, and the plug body 130 is therefore free to rotate with respect to the lock shell. In embodiments which utilize additional or alternative tumbler systems, the unlocked state will allow the plug body to rotate with respect to the lock shell. For example, if the tumbler system includes pin tumblers, the driven pins will not protrude beyond outer circumferential surface 131.

In the illustrated embodiment, the pivoting member 140 rotates about a pivot point or axis 141 that may be arranged generally parallel with the axial centerline C, and is biased toward a closed position (FIG. 1) via the biasing mechanism 142. The pivot point/axis 141 may be maintained in a stationary position with respect to the plug housing 130, and may be coupled to the lock shell. In the illustrated embodiment, the biasing mechanism 142 includes a biasing member 143 which exerts a biasing force onto the pivoting member 140 through a connection or bearing member 144. The bearing member 144 may be integral with, attached to, or positioned in contact with the pivoting member 140. In some embodiments, the biasing member 143 may directly engage the pivoting member 140, thereby eliminating the bearing member 144. In the illustrate embodiment, the pivoting member 140 is constrained to pivotal movement. However, in other embodiments, the pivoting member 140 may additionally or alternatively be movable in another direction.

The pivoting member 140 may extend generally in an axial direction along disc stack 104 (i.e., along the axial centerline C), and includes an arcuate inner bearing surface 145, an interference contact surface 147 that terminates at a tip portion 148, and an extended distal portion 149. The inner bearing surface 145 is configured to be displaced along the outer surfaces 115, 125 of the radial protrusions 116, 126 once the pivoting member 140 has been moved away from and out of the closed position. In the illustrated embodiment, the inner bearing surface 145 is of a constant arc radius that generally corresponds to the outer arc radius of the outer surfaces 115, 125 of the radial protrusions 116, 126. It is also contemplated that the inner bearing surface 145 may have a varying arc radius, for example, if the outer surfaces 115, 125 of the radial protrusions 116, 126 do not define a substantially uniform outer arc radius.

As should be appreciated, the interference surface 147 of the pivoting member 140 is configured to prevent rotation of the locking discs 110 about the axial centerline C when the pivoting member 140 is in the closed position (FIG. 1). In the closed position, the interference surface 147 of the pivoting member 140 is generally radially aligned with the interference surfaces 117 of the locking discs 110, thereby blocking the rotational travel path of the radial protrusions 116 and preventing rotation of the locking discs 110. Because the locking discs 110 cannot rotate, they will remain in an aligned position. If a user attempts to rotate one or more of the locking discs 110, the interference surface 147 will engage the interference surface 117, thereby preventing rotation of the locking disc. By maintaining the locking discs 110 in the aligned position until a proper key is fully inserted into the keyway of the locking system 100, the locking system 100 not only alerts the user when the key is not fully inserted, but also obviates the need for a user to turn the key back and forth in order to realign the discs.

To reduce internal stresses resulting from a user applying excessive force to the key when the pivoting member 140 is in the closed position, it is desirable to increase the area of contact between the interference surfaces 117 and 147. To this end, the radial protrusions 116 and the pivoting member 140 may be configured such that interference surfaces 117, 147 are substantially parallel to one another when they are positioned in contact with one another. Additionally, in the illustrated embodiment, each locking disc 110 is configured such that when the pivoting member 140 is in the closed position, the tip portion 148 is positioned at least partially within the hooked recesses 118 of the locking discs 110, thereby increasing the area of contact between interference surfaces 117, 147. It is also contemplated that the hooked recess 118 may be absent in one or more of locking discs 110, in which case the tip portion 148 may contact the circumferential surface 111.

The extension 149 of the pivoting member 140 is generally aligned in the axial direction with the driver disc 120, and is configured to interact with the radial protrusion 126 of the driver disc 120. While the extension 149 extends beyond the interference surface 147 substantially only along the curved arc defined by the pivoting member 140, it is also contemplated that an extension may extend in a direction toward the radial protrusion 126. When the driver disc 120 is rotated, the contact bearing surface 127 urges the extension 149 away from the axial centerline C, thereby pivotally displacing the pivoting member 140 away from and out of the closed position.

When the outer surface 115 of the locking discs 110 contacts the inner surface 145 of the pivoting member 140, the pivoting member 140 will be positioned in an open position (FIG. 2) wherein the interference surface 147 is no longer radially aligned with the interference surfaces 117 of the locking discs 110, and the locking discs 110 are thereby free to rotate about the axial centerline C. When the pivoting member 140 is positioned in the open position, the biasing mechanism 142 continues to exert a biasing force onto the pivoting member 140. This biasing force causes the inner bearing surface 145 to exert a radially inward force onto the outer surfaces 115, 125 of the radial protrusions 116, 126, thereby resulting in a corresponding frictional force which resists rotation of the discs 110, 120 about the axial centerline C. This frictional force continues to resist rotation of the discs 110, 120, even when the disc's groove/indentation 112, 122 is aligned with the axial channel 132 of the plug body 130. The added frictional force increases the difficulty of sensing a change in resistive force, making it much more difficult for a person attempting to pick the lock to determine when the discs are in the proper position for unlocking of the lock system 100.

While the invention has been illustrated and described in detail in the drawings and foregoing description, the same is to be considered as illustrative and not restrictive in character, it being understood that only the preferred embodiments have been shown and described, and that all changes and modifications that come within the spirit of the inventions are desired to be protected. It should be understood that while the use of words such as preferable, preferably, preferred, or more preferred used in the description indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used, there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A lock apparatus, comprising:

a plurality of locking discs rotatable about a rotational axis between locked and unlocked states, each of said locking discs having a locking engagement surface and an outer surface;

a driver disc rotatable about said rotational axis and having a driving engagement surface;

a movable catch having a locked position and an unlocked position, said movable catch having a catch surface that abuts said locking engagement surface of said locking discs when said movable catch is in said locked position wherein rotation of said locking discs is inhibited, and wherein said catch surface does not abut said locking engagement surface of said locking discs when said movable catch is in said unlocked position wherein rotation of said locking discs is enabled; and wherein said driving engagement surface of said driver disc engages a portion of said movable catch upon rotation of said driver disc about said rotational axis to thereby displace said movable catch from said locked position to said unlocked position.

2. The lock apparatus of claim 1, wherein said catch surface and said locking engagement surface are aligned with one another when said movable catch is in said locked position, and wherein said catch surface and said locking engagement surface are not aligned with one another when said movable catch is in said unlocked position.

3. The lock apparatus of claim 1, wherein said movable catch is pivotal about a pivot axis between said locked and unlocked positions.

4. The lock apparatus of claim 1, wherein said portion of said movable catch that is engaged by said driving engagement surface of said driver disc comprises a distal extension portion of said movable catch that extends distally beyond said catch surface.

5. The lock apparatus of claim 4, wherein said distal extension portion of said movable catch includes a bearing surface engaged by said driving engagement surface of said driver disc, said bearing surface arranged generally perpendicular to said catch surface.

6. The lock apparatus of claim 1, wherein said outer surface of said locking discs comprises a circumferential outer surface, and wherein each of said locking discs includes a radial protrusion extending radially outward from said circumferential outer surface, said radial protrusion defining said locking engagement surface.

7. The lock apparatus of claim 6, wherein said radial protrusion has a first width at a radially distal extent of said radial protrusion and a second width at a radially proximal extent of said radial protrusion adjacent said circumferential outer surface that is less than said first width to provide said radial protrusion with an undercut region.

8. The lock apparatus of claim 1, wherein each of said locking discs and said driver disc defines a keyway opening arranged generally along said rotational axis, said keyway opening sized and configured for receipt of a key.

9. The lock apparatus of claim 1, wherein said driver disc is not positioned between any two of said locking discs.

10. The lock apparatus of claim 1, further comprising a biasing mechanism that exerts a biasing force onto said movable catch to urge said movable catch into engagement with said outer surface of said locking discs.

11. The lock apparatus of claim 10, wherein said biasing mechanism urges said movable catch toward said locked position.

12. The lock apparatus of claim 10, wherein said biasing mechanism urges said movable catch into engagement with said driver disc.

13. The lock apparatus of claim 10, wherein said biasing mechanism urges said movable catch into engagement with said outer surface of said locking discs to provide a resistive force that resists rotation of said locking discs when said movable catch is in said unlocked position.

14. The lock apparatus of claim 13, wherein said movable catch comprises a concave bearing surface that is urged into engagement with a convex portion of said outer surface of said locking discs by said biasing mechanism.

15. The lock apparatus of claim 10, wherein said biasing mechanism comprises a spring.

16. The lock apparatus of claim 1, wherein said movable catch includes a concave bearing surface that is biased into engagement with a convex portion of said outer surface of said locking discs to provide a resistive force that resists rotation of said locking discs when said movable catch is in said unlocked position.

17. The lock apparatus of claim 16, wherein said concave bearing surface of said movable catch is urged into engagement with said driver disc to provide a resistive force that resists rotation of said driver disc.

18. A lock apparatus, comprising:

a plurality of locking discs rotatable about a rotational axis between locked and unlocked states, each of said locking discs having a locking engagement surface and an outer surface;

a driver disc rotatable about said rotational axis and having a driving engagement surface;

a movable catch having a locked position and an unlocked position, said movable catch having a catch surface that abuts said locking engagement surface of said locking discs when said movable catch is in said locked position wherein rotation of said locking discs is inhibited, and wherein said catch surface does not abut said locking engagement surface of said locking discs when said movable catch is in said unlocked position wherein rotation of said locking discs is enabled;

a tumbler system; and a plug housing defining an interior arranged generally along said rotational axis and including a channel extending generally along said rotational axis;

wherein said driving engagement surface of said driver disc engages a portion of said movable catch upon rotation of said driver disc about said rotational axis to thereby displace said movable catch from said locked position to said unlocked position; and wherein each of said locking discs includes an indentation extending radially inward from said outer surface, said indentation configured to receive a portion of said tumbler system when aligned with said channel, each of said plurality of locking discs having a misaligned configuration wherein said indentation is not aligned with said channel and an aligned configuration wherein said indentation is generally aligned with said channel for receipt of said portion of said tumbler system.

19. The lock apparatus of claim 18, wherein said portion of said tumbler system comprises a locking bar sized for receipt within said channel in said plug housing and said indentation in said locking discs.

20. A lock apparatus, comprising:

a plurality of locking discs rotatable about a rotational axis between locked and unlocked states, each of said plurality of locking discs including a circumferential outer surface and a locking engagement surface;

a driver disc rotatable about said rotational axis and defining a driving engagement surface;

a lever pivotal about a pivot axis between a locked position and an unlocked position, said lever having an interference surface and a bearing surface, said interference surface abuts said locking engagement surface of said locking discs when said lever is in said locked position wherein rotation of said locking discs about said rotational axis is inhibited; and a biasing mechanism that exerts a biasing force onto said lever to urge said lever into engagement with said locking discs wherein said bearing surface of said lever bears against said circumferential outer surface of said locking discs to resist rotation of said locking discs about said rotational axis when said lever is in said unlocked position; and wherein said driving engagement surface of said driver disc engages a portion of said lever upon rotation of said driver disc about said rotational axis to displace said lever from said locked position to said unlocked position.

21. The lock apparatus of claim 20, wherein each of said plurality of locking discs includes a radial protrusion extending radially outward from said circumferential outer surface, said radial protrusion defining said locking engagement surface.

22. The lock apparatus of claim 21, wherein said driver disc includes a radial protrusion defining said driving engagement surface.

23. The lock apparatus of claim 21, wherein said radial protrusion has a first width at a radially distal extent and a second width at a radially proximal extent adjacent said circumferential outer surface that is less than said first width to provide said radial protrusion with an undercut region.

24. The lock apparatus of claim 20, wherein said portion of said lever engaged by said driving engagement surface of said driver disc comprises a distal extension portion of said lever extending distally beyond said interference surface.

25. The lock apparatus of claim 20, wherein said bearing surface of said lever comprises a concave surface that bears against a convex portion of said circumferential outer surface of said locking discs to resist rotation of said locking discs about said rotational axis when said lever is in said unlocked position.

* * * * *